US012723385B2

(12) United States Patent
Wang et al.

(10) Patent No.: US 12,723,385 B2
(45) Date of Patent: Sep. 1, 2026

(54) FAUCET BODY ASSEMBLY AND BASIN FAUCET

(71) Applicant: CLEMENT INC., Flushing, NY (US)

(72) Inventors: Chunhua Wang, Xiamen (CN); Yongqiang Yan, Fuzhou (CN)

(73) Assignee: CLEMENT INC., Flushing, NY (US)

( * ) Notice: Subject to any disclaimer, the term of this patent is extended or adjusted under 35 U.S.C. 154(b) by 0 days.

(21) Appl. No.: 19/014,292

(22) Filed: Jan. 9, 2025

(65) Prior Publication Data

US 2026/0168219 A1 Jun. 18, 2026

(30) Foreign Application Priority Data

Dec. 12, 2024 (CN) ..... 202423067064.1

(51) Int. Cl.
*E03C 1/04* (2006.01)

(52) U.S. Cl.
CPC ..... *E03C 1/0404* (2013.01)

(58) Field of Classification Search
CPC ..... E03C 1/0404
See application file for complete search history.

(56) References Cited

U.S. PATENT DOCUMENTS

| | | | | |
|---|---|---|---|---|
| 4,763,693 | A * | 8/1988 | Valley | E03C 1/0404 285/275 |
| 7,698,755 | B2 * | 4/2010 | McNerney | E03C 1/0401 4/695 |
| 8,302,620 | B2 * | 11/2012 | Lin | E03C 1/04 285/376 |
| 9,376,791 | B2 * | 6/2016 | Wilkerson | E03C 1/0401 |
| 9,428,891 | B2 * | 8/2016 | Tzeng | E03C 1/0403 |
| 2014/0150896 | A1 * | 6/2014 | Guan | F16K 19/006 137/315.01 |
| 2016/0333554 | A1 * | 11/2016 | Fry | E03C 1/0403 |
| 2021/0340743 | A1 * | 11/2021 | Zhang | F16K 31/60 |
| 2022/0064918 | A1 * | 3/2022 | Zhang | F16K 31/60 |

* cited by examiner

*Primary Examiner* — Patrick C Williams

(57) ABSTRACT

The present disclosure provides a faucet body assembly and a basin faucet. The faucet body assembly includes a water mixing seat; a valve core seat symmetrically arranged on two sides of the water mixing seat, wherein an end of the valve core seat is formed with a valve core mount; and a connection tube connecting the water mixing seat and the valve core seat. The structure of the present disclosure is easy to assemble, and the water mixing seat and the valve core seat are made of stainless steel to avoid aging of the structure and improve the sealing performance of the overall structure as well as enhance the strength. Moreover, the valve core seat is made by assembling and welding which needs no additional mold that is specially designed, thereby avoiding material waste during the molding process and saving the cost.

9 Claims, 18 Drawing Sheets

Valve core A

Valve core B

FAUCET BODY ASSEMBLY AND BASIN FAUCET

TECHNICAL FIELD

The present disclosure relates to a faucet body assembly and a basin faucet.

BACKGROUND

The four-inch basin faucet is a type of kitchen and bathroom device, mainly used for water flow control in hand basins or wash basins. The valve body used with the faucet is a major component in the valve, which can be used to control the direction, pressure, and flow of the fluid. After the valve core and the valve seat seal ring are sealed, the valve body can effectively withstand the medium pressure. However, the valve body in the traditional four-inch basin faucet is generally made of plastic, which has a relatively low strength and is prone to aging and leakage; and the water inlet connector of the valve body needs other adapter products to connect to the angle valve, which makes assembly more complicated.

SUMMARY

The present disclosure provides a faucet body assembly and a basin faucet, which can effectively solve the above problems.

The technical solution of the present disclosure is as follows.

A faucet body assembly, comprising:

a water mixing seat;

a valve core seat, wherein the valve core seat is symmetrically arranged on two sides of the water mixing seat, and an end of the valve core seat is formed with a valve core mount;

a connection tube connecting the water mixing seat and the valve core seat;

wherein a water passage of the faucet body assembly comprises water flowing in from a water inlet of the valve core seat, after being regulated by the valve core seat, passing through the connection tube, and then entering the water mixing seat, cold and hot water from a left inlet and a right water inlet of the valve core seat being mixed in the water mixing seat and flowing out from the water mixing seat, and threads on a water outlet of the water mixing seat is connectable with a water outlet device;

the valve core seat and the water mixing seat or the valve core seat is welded by any of the following means:

configuring at least one of a water inlet of the water mixing seat and a water outlet of the valve core seat with a concave cylindrical surface, and configuring at least one of the two ends of the connection tube with an arc surface matched with the cylindrical surface to form a welding spot, or configuring at least one of the water inlet of the water mixing seat and the water outlet of the valve core seat with the concave cylindrical surface, and inserting at least one of the two ends of the connection tube into the cylindrical surface; and configuring at least one of the two ends of the connection tube with an arc surface matched with the water mixing seat or the valve core seat to form the welding spot, or configuring at least one of the water inlet of the water mixing seat and the water outlet of the valve core seat as a step hole, inserting at least one of the two ends of the connection tube into the step hole and to butt up against the step hole, and configuring the joint of at least one of the two ends of the connection tube with a flat surface; and at least one of the two ends of the connection tube forming a step hole welding spot matched with the mixing seat or the valve core seat.

As a further improvement, the faucet body assembly further comprises a water inlet hose assembly, wherein water inlet hose assembly includes a hose, a connection end arranged at the top of the hose and a water inlet connector arranged at the bottom of the hose; the connection end is engaged with the valve core mount; and the hose extends from the top of the valve core seat to the outside from top to bottom.

As a further improvement, at least two sets of annular grooves are formed on the connection end, and first sealing rings for sealing are sleeved on the annular grooves.

As a further improvement, the valve core seat includes an external sleeve, a first water sealing ring arranged on a lower side of an inner wall of the external sleeve, and a threaded tube arranged below the first water sealing ring.

As a further improvement, the first water sealing ring is welded to the lower side of the inner wall of the external sleeve by a first welding point; the threaded tube is welded to a lower portion of the first water sealing ring by a second welding point, and the threaded tube is welded to the inner wall of the external sleeve by a third welding point.

As a further improvement, the connection end of the water mixing seat is formed with first external threads, and the connection end of the water mixing seat is also connected with a water outlet connector.

As a further improvement, a lock nut is sleeved on an end of the water outlet connector, and an end of the lock nut is formed with internal threads for matching and fixing with the first external threads.

As a further improvement, the valve core seat further comprises a steel tube and a third water sealing ring arranged between the valve core seat and the steel tube.

As a further improvement, another end of the valve core seat is provided with a notch.

The present disclosure further provides a basin faucet comprising the above-mentioned faucet body assembly, the basin faucet further comprises a decorative cover plate, a base plate sealed to the decorative cover plate, a first locking nut arranged below the base plate and configured to assemble and fix an end of the hose, and the faucet body assembly is arranged above the decorative cover plate.

The present disclosure has the following advantages.

(1) In the present disclosure, with the use of different welding methods, the structural stability and durability of the faucet body are improved, the exposed area of the weld joint is reduced, the exposure to corrosive media is reduced, the welding process is simplified, the production time and cost are reduced, and the production efficiency is improved.

(2) In the present disclosure, the basin faucet body is made of stainless steel, which is well known for its excellent corrosion resistance and wear resistance, and can effectively resist the erosion from water and various cleaning agents in long-term use, thereby prolonging the service life of the product. The good hardness of stainless steel also means that it can withstand the impact and pressure in daily use, thereby lowering the risk of damage.

(3) In the present disclosure, the external sleeve, the first water sealing ring and the threaded tube are fixed by welding technology to form an additional connection point. This structural design significantly enhances the stability of the valve core seat. Under the working conditions of high pressure or large flow, this stability can prevent the connection tube from loosening or leaking, thereby improving the safety and reliability of the entire faucet body.

(4) In the present disclosure, the quick assembly and disassembly functions in the design make the installation and maintenance of the hose very simple and quick, and the user can complete these operations without complicated tools or professional knowledge, which greatly saves the time and labor of installation and maintenance and improves work efficiency.

(5) In the present disclosure, a high-quality O-ring is used as the first sealing ring. This material can form an airtight or liquid-tight isolation layer between mechanical parts to effectively prevent fluid or gas leakage. In addition, the design of multiple sets of sealing rings further enhances the sealing performance of the water outlet connector, ensuring long-term watertightness.

(6) In the present disclosure, compared with the manufacturing method of integrated molding, the method of assembling by welding can reduce material waste and lower production costs. This improvement in cost-effectiveness makes the product more competitive in the market and also provides manufacturers with a higher profit margin.

(7) The present disclosure includes an easy-to-operate handle and valve core, and the user can easily control the water flow, thereby improving the user experience. This humanized design takes into account the actual needs of the user, making the product easier to use and improving the user's satisfaction.

(8) The design of the locking cover of the present disclosure is configured to hide the screws. This design not only makes the product more pleasing to the eye, but also maintains the neatness and uniform appearance of the product. The detail-oriented design makes the product more visually attractive and also reduces the difficulty of cleaning.

(9) In the present disclosure, the product is more competitive in the market by optimizing the design and reducing the cost. The basin faucet body can attract more consumers with its excellent performance, durability and aesthetics, thus standing out in the fierce market competition.

(10) In the present disclosure, due to the improvement of structural stability and sealing performance, the maintenance cost caused by leakage or damage is lowered. This design makes the product more reliable in long-term use, reduces the frequency of repair and replacement, and thus saving maintenance costs for users.

(11) The design of the present disclosure allows the use of components of different materials, such as stainless steel, iron or plastic, to adapt to different application scenarios and cost requirements. This flexibility allows the product to meet the needs of different users and improves the versatility and adaptability of the product.

BRIEF DESCRIPTION OF THE DRAWINGS

In order to more clearly illustrate the technical solutions of the embodiments of the present disclosure, the drawings required for illustrating the embodiments will be briefly introduced below. It should be understood that the following drawings only show certain embodiments of the present disclosure and therefore should not be regarded as limiting the scope. For those of ordinary skill in the art, other related drawings can be derived based on these drawings without paying creative efforts.

Figure 1:
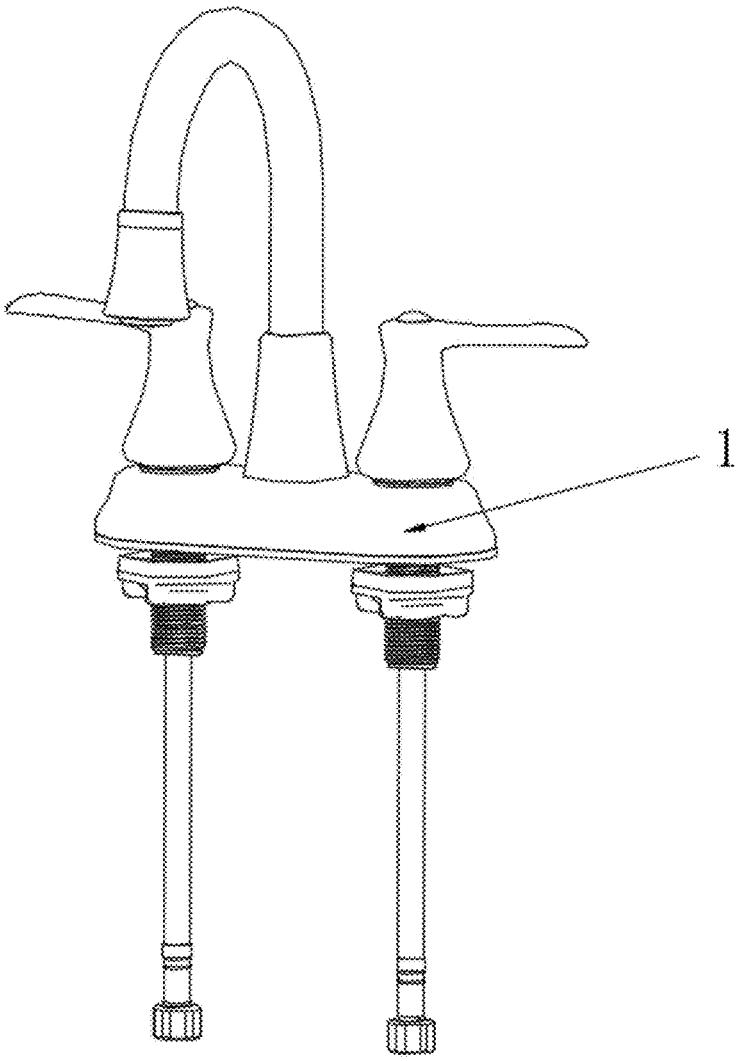
FIG. 1 is a front view of the present disclosure.

The reference numerals in the drawings are listed below:

1. decorative cover plate;

2. water mixing seat; 20. valve core mount; 2-0. valve core seat; 2-60. cylindrical surface; 2-62. step hole; 2-00. connection tube; 2-01. arc surface; 2-02. flat surface; 2-1. external sleeve; 2-2. first water sealing ring; 2-3. threaded tube; 2-4. first welding point; 2-5. second welding point; 2-6. third welding point;

3. water inlet hose assembly; 30. hose; 31. connection end; 32. first sealing ring; 33. water inlet connector; 34. annular groove; 35. water inlet;

6. base plate; 7. first locking nut; 8. handle; 9. pressing cap; 10. gasket; 11. valve core; 12. screw; 13. locking cover; 14. second locking nut; 15. elbow tube; 16. clamping ring; 17. second sealing ring; 18. aerator assembly; 19. first external threads; 20. lock nut; 21. internal threads; 22. water outlet connector; 23. steel tube; 24. third water sealing ring; 25. notch; 26. second external threads; 27. interface; 28. fourth welding spot; 29. water inlet adapter.

DETAILED DESCRIPTION OF THE EMBODIMENTS

In order to make the purpose, technical solutions and advantages of the embodiments of the present disclosure clearer, the technical solutions in the embodiments of the present disclosure will be clearly and completely described below in conjunction with the drawings in the embodiments of the present disclosure. Obviously, the described embodiments are part of the embodiments of the present disclosure rather than all. Based on the embodiments of the present disclosure, all other embodiments derived by those of ordinary skill in the art without creative effort should be considered as falling within the scope of protection of the present disclosure. Therefore, the details of the embodiments of the present disclosure shown in the drawings are not intended to limit the scope of the present disclosure seeking for protection, but merely represents selected embodiments of the present disclosure.

In the description of the present disclosure, the terms "first" and "second" are used for descriptive purposes only and should not be understood as indicating or implying relative importance or implicitly indicating the number of the indicated technical features. Thus, a feature defined as "first" or "second" may explicitly or implicitly include one or more of the features. In the description of the present disclosure, the term "plurality" means two or more, unless otherwise clearly and specifically defined.

Embodiment 1

A faucet body assembly having a structure shown in FIGS. 1-4 includes a water mixing seat 2, a valve core seat 2-0, which is symmetrically arranged on two sides of the water mixing seat 2, and an end of the valve core seat 2-0 is formed with a valve core mount 20, and a connection tube 2-00 connecting the water mixing seat 2 and the valve core seat 2-0. Specifically, the water mixing seat 2 and the valve core seat 2-0 are made of metal materials such as stainless steel and copper, the material includes the above two metal materials but is not limited thereto, and it can be selected according to actual needs.

Figure 14:
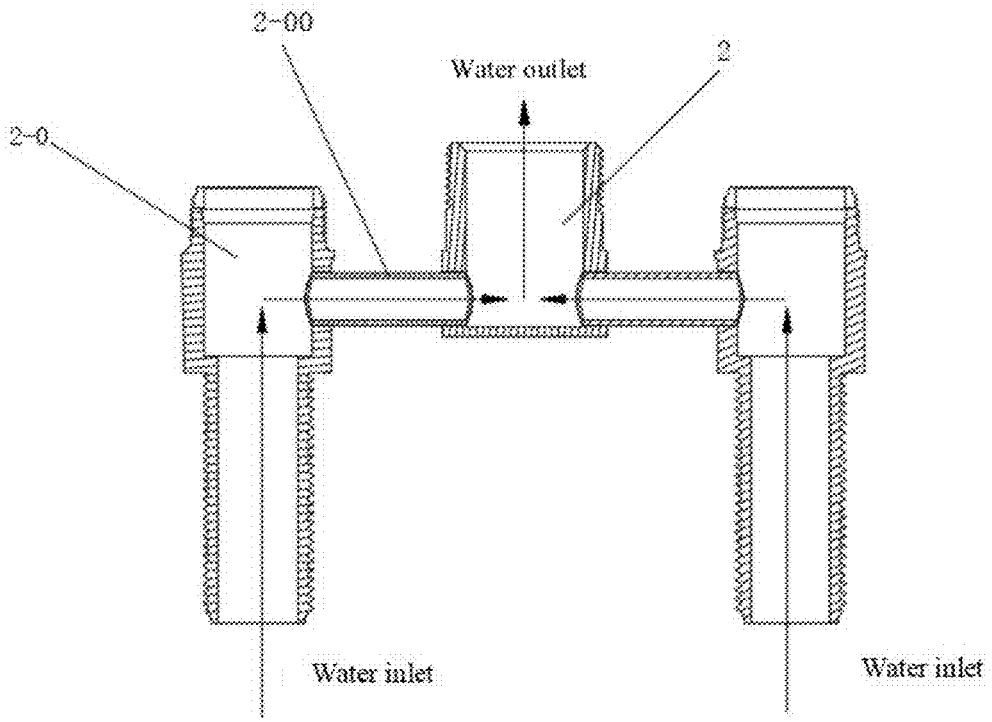
FIG. 14 is a schematic diagram of the water flow direction of the water mixing seat, valve core seat and connection tube of the present disclosure.

Referring to FIG. 14, the connection tube 2-00 connects the water mixing seat 2 and the valve core seat 2-0. Specifically, the water passage of the faucet body assembly includes water flowing in from the water inlet of the valve core seat 2-0, after being regulated by the valve core seat 2-0, water entering the water mixing seat 2 through the connection tube 2-00, the cold and hot water from the left and right water inlets of the valve core seat 2-0 reach and are mixed in the water mixing seat 2, and then flowing out from the water mixing seat 2. Further, the water outlet threads of the water mixing seat 2 are connectable to various water outlet devices.

The water inlet hose assembly 3 includes a hose 30, a connection end 31 arranged at the top of the hose 30, and a water inlet connector 33 arranged at the bottom of the hose 30. The connection end 31 is engaged with the valve core mount 20, and the hose 30 extends out from the bottom of the valve core seat 2-0 and is connected to an angle valve through the water inlet connector 33. At least two sets of annular grooves 34 are formed on the connection end 31, and a first sealing ring 32 for sealing is sleeved on the annular groove 34. Specifically, the first sealing ring 32 is an O-ring, and the O-ring will form an airtight or liquid-tight isolation layer between mechanical parts during use to prevent fluid or gas leakage.

Figure 13:
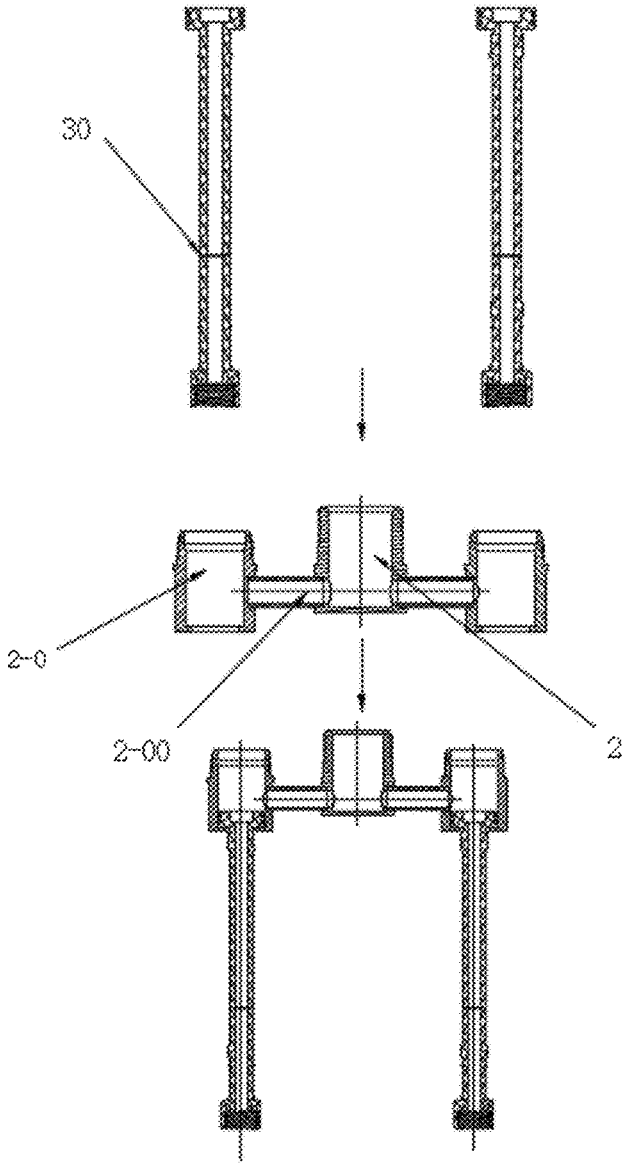
FIG. 13 is a schematic diagram of the installation of the hose and the faucet body of the present disclosure.

Referring to FIG. 13, further, the method to install the hose 30 and the valve core seat 2-0 also includes (1) installing the hose 30 from the top of the valve core seat 2-0 from top to bottom, and installing the valve core; or (2) installing the hose 30 from the bottom of the valve core seat 2-0 from bottom to top, and installing the valve core. The above methods are both suitable for the installation of the hose 30. In order to accelerate the installation, preferably, the method of installing the hose 30 from the top of the valve core seat 2-0 from top to bottom and installing the valve core is more convenient and faster. This is because the top of the valve core seat 2-0 is easier to access, and the installation of the hose 30 and the valve core can be performed directly from the top without the need to provide additional support or complex positioning devices. This method can quickly complete the installation if there is enough space. While the method that the hose 30 is installed from the bottom of the valve core seat 2-0 from bottom to top, and the valve core is installed is more suitable when the bottom of the valve core seat 2-0 is easier to access or when the space of the top is limited. This method may be more time-consuming to ensure that the hose 30 is correctly aligned and inserted into the right position, especially when the space of the bottom is small or difficult to operate, so this method may be of low efficiency. Preferably, the hose 30 is installed from the top of the valve core seat 2-0 from top to bottom.

Specifically, when the O-ring is mounted into the sealing groove, the O-ring will undergo elastic deformation due to the contact compression stress on its cross section. This deformation causes the O-ring to have a certain initial contact pressure Po on the contact surface. This pressure is caused by the initial compression of the O-ring and exists even in the absence of medium pressure. When the pressurized medium (such as gas or liquid) is filled into the container, the O-ring will be affected by the medium pressure. This pressure will cause the O-ring to move to the low-pressure side. At the same time, the elastic deformation of the O-ring is even more to better fill and block the original gap δ. As the O-ring moves and deforms, the contact pressure acting on the coupling surface of the sealing pair will increase. The final contact pressure Pm is the sum of the initial contact pressure Po and the additional contact pressure Pp caused by the medium pressure, that is, $Pm=Po+Pp$. Pp is the contact pressure transmitted to the contact surface through the O-ring, and its relationship with the medium pressure P is $Pp=K\cdot P$, wherein K is the pressure transmitting coefficient, which describes the extent to which the medium pressure is transmitted to the contact surface. In terms of the rubber O-rings, the value of K is usually 1, which means that all the pressure of the medium is transmitted to the contact surface. Thus, when the O-ring is subjected to the pressure of the medium, it can increase the contact pressure through elastic deformation, thereby improving the sealing effect. Further, when the O-ring is compressed, its inner and outer diameters will deform slightly so as to fill the gap of the sealing surface and form an effective sealing layer, which effectively prevents the leakage of liquid, gas or dust.

Furthermore, in order to ensure that the O-ring is not deformed or damaged during installation, and to quickly and accurately mount the O-ring in place, the following matters need attention when installing: before installing the O-ring, a layer of lubricant may be applied on the surface of the O-ring to reduce friction, make the O-ring easier to install, and help improving the sealing effect.

Furthermore, the water inlet connector 33 is a quick-release water inlet pipe nut.

The valve core seat 2-0 includes an external sleeve 2-1, a first water sealing ring 2-2 arranged at the lower side of the inner wall of the external sleeve 2-1, and a threaded tube 2-3 arranged below the first water sealing ring 2-2.

In use, the nut of the water inlet pipe at an end of the hose 30 can be unscrewed and the hose 30 reaches the interior of the valve core seat 2-0. After the hose 30 extends out of the valve core seat 2-0, the connection end 31 on the water inlet connector 33 at the other end of the hose 30 is engaged with the valve core mount 20 to limit the hose 30. The first sealing ring 32 is sleeved on the annular groove 34 and is connected to either end of the valve core seat 2-0 in a sealing manner, so that the valve body can be quickly connected to the angle valve without the need to use other adapter products, and the assembly is simple.

Figure 6:
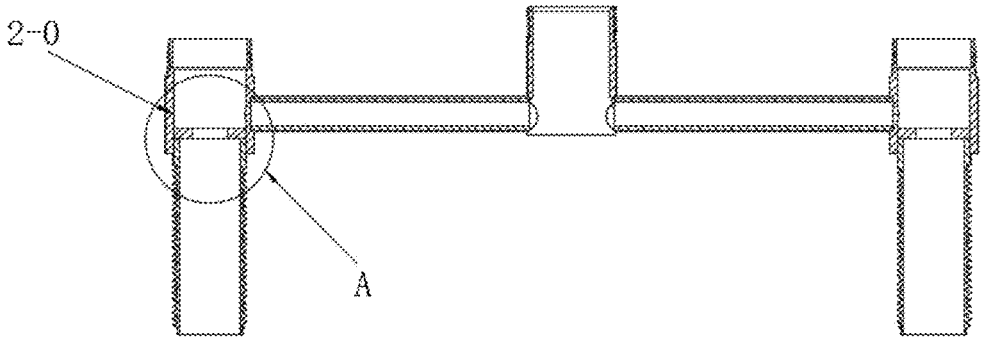
FIG. 6 is a schematic diagram of Embodiment 1.
Figure 7:
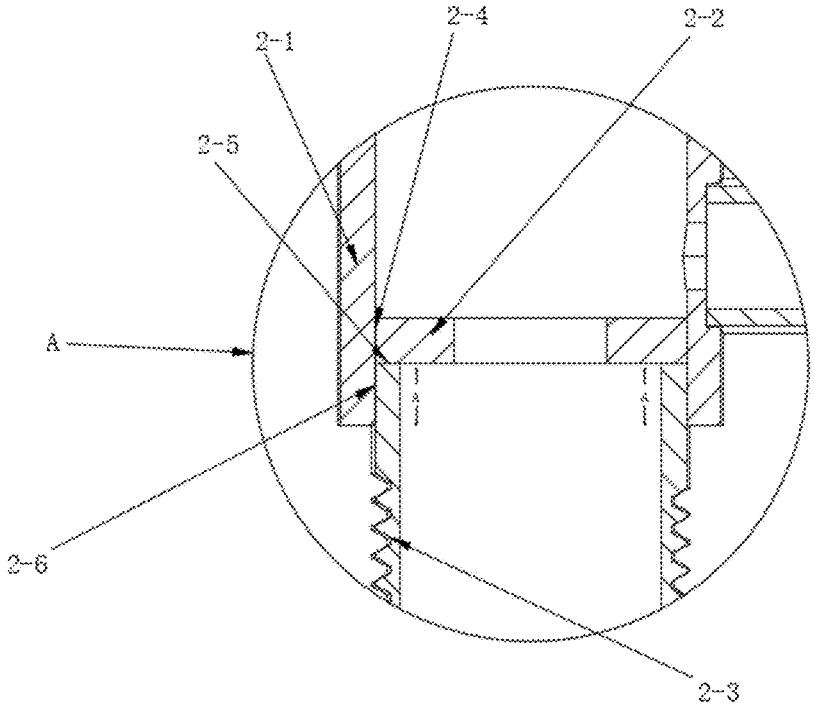
FIG. 7 is an enlarged view of A in Embodiment 1.

Further, referring to FIGS. 6-7, the valve core seat 2-0 includes an external sleeve 2-1, a first water sealing ring 2-2 arranged on the lower side of the inner wall of the external sleeve 2-1, and a threaded tube 2-3 arranged below the first water sealing ring 2-2. The advantage of such a configuration is that the valve core seat 2-0 and the external sleeve 2-1 that are integrated in conventional production are now produced separately, which can greatly reduce the cost. Further, the first water sealing ring 2-2 is welded to the lower side of the inner wall of the external sleeve 2-1 through a first welding point 2-4; the threaded tube 2-3 is welded to a lower portion of the first water sealing ring 2-2 through a second welding point 2-5, and the threaded tube 2-3 is welded to the inner wall of the external sleeve 2-1 through a third welding point 2-6.

Further, the external sleeve 2-1 is a part of the valve body, and the method of welding can ensure a firm connection between the external sleeve 2-1 and other parts to prevent loosening or leakage under high pressure or large flow conditions. Additionally, the first water sealing ring 2-2 is usually a sealing member for waterproofing and is for preventing leakage when fluid passes through the valve or related parts. The first water sealing ring 2-2 is fixed to a suitable position by welding, which can effectively prevent fluid leakage for a long time. Further, the threaded tube 2-3 is similar to the external sleeve 2-1 and is also a complementary part of the valve body or other parts to be connected with other parts (the other parts here are prior art and will not be described in detail here). Through welding, the threaded tube 2-3 can form a stable overall structure with the external sleeve 2-1 and the first water sealing ring 2-2. When the external sleeve 2-1, the first water sealing ring 2-2, and the threaded tube 2-3 are welded to each other, a connection joint is formed therebetween. This connection joint can not only ensure the sealing performance between the three parts, but also can improve the strength between the three parts. This is because, after the three parts are welded, welding spots similar to reinforcing ribs are formed, thereby ensuring the strength of the entire structure.

Figure 10:
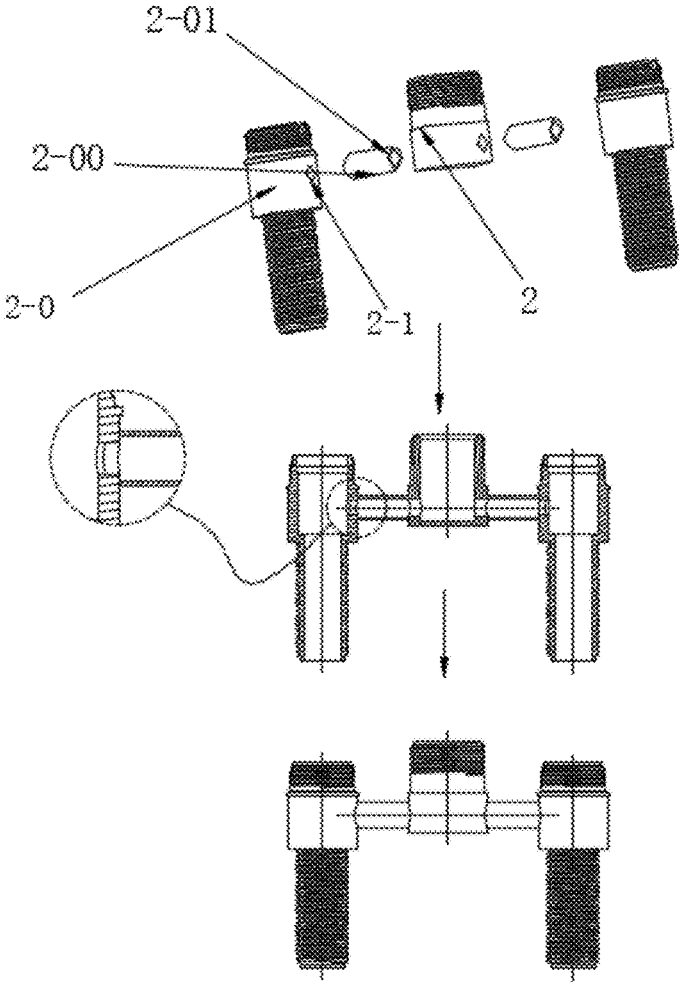
FIG. 10 is a diagram showing the first welding installation state of the faucet body of the present disclosure.
Figure 11:
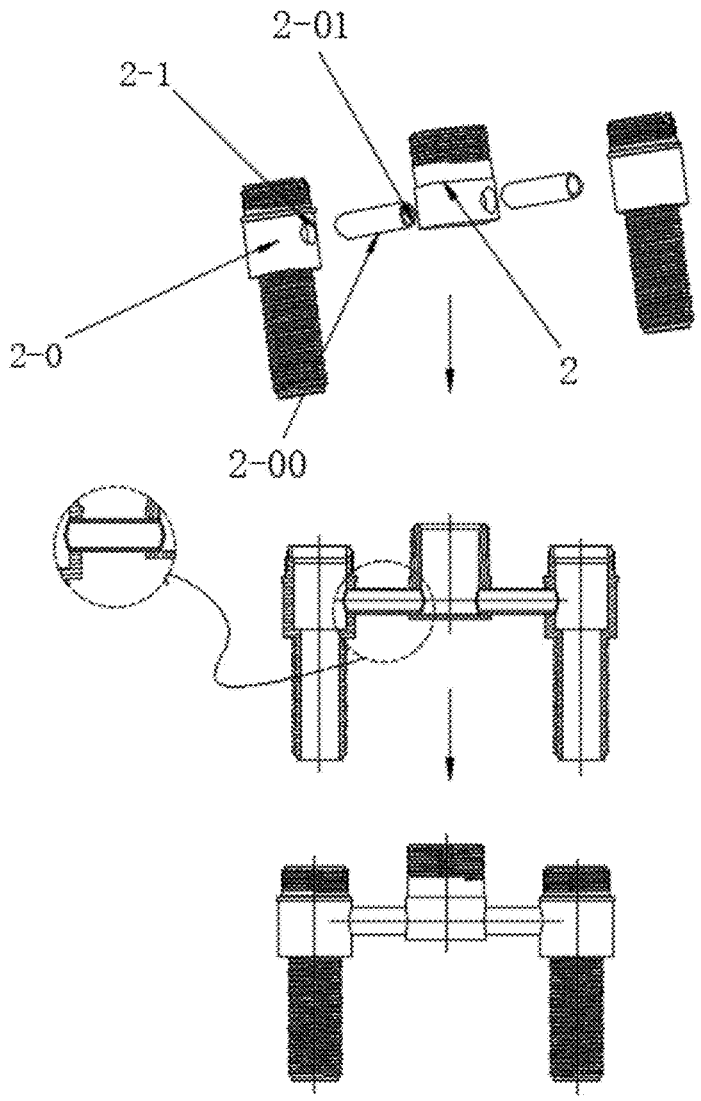
FIG. 11 is a diagram showing a second welding installation state of the faucet body of the present disclosure.
Figure 12:
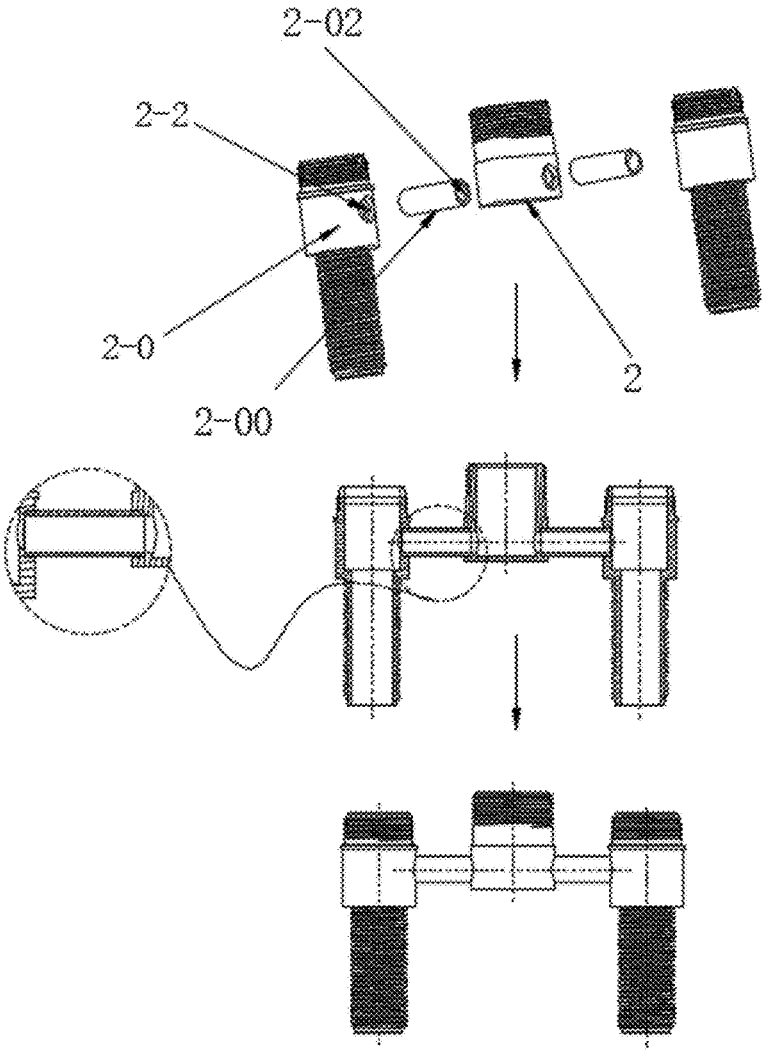
FIG. 12 is a diagram showing the third welding installation state of the faucet body of the present disclosure.

Further, referring to FIGS. 10-12, the valve core seat 2-0, the water mixing seat 2 or the valve core seat 2-0 are welded by any of the following methods.

Method 1

At least one of the water inlet of the water mixing seat 2 and the water outlet of the valve core seat 2-0 is a concave cylindrical surface 2-60, and at least one of the two ends of the connection tube 2-00 forms a welding spot with an arc surface 2-01 that matches the cylindrical surface 2-60.

Furthermore, the valve core seat 2-0 is placed at the left and right ends of the water mixing seat 2 respectively in a symmetrical manner, and the valve core seat 2-0 is connected with the water mixing seat 2 by connection tubes 2-00 pairwise. Namely, the water outlet at the left side of the valve core seat 2-0 is welded to the left side of the connection tube 2-00, and the right side of the connection tube 2-00 is welded to the water inlet at the left side of the water mixing seat 2, and the water outlet at the right side of the valve core seat 2-0 is welded to the right side of the connection tube 2-00, and the left side of the connection tube 2-00 is welded to the water inlet at the right side of the water mixing seat 2, such that the faucet body assembly is established. Additionally, the welding spot of the valve core seat 2-0 and the water mixing seat 2 is a cylindrical surface 2-60, the welding spot of the connection tube 2-00 is configured as an arc surface 2-01 to adapt to the valve core seat 2-0 and the water mixing seat 2, thereby increasing the contact area between the valve core seat 2-0 and the water mixing seat 2. This welding method can achieve higher welding strength and stability, optimize stress distribution, and reduce stress concentration in the welding area, thereby reducing the risk of cracks and deformation, and further, simplify the welding process, reduce welding time and cost, and improve production efficiency.

Method 2

At least one of the water inlet of the water mixing seat 2 and the water outlet of the valve core seat 2-0 is a concave cylindrical surface 2-60, and at least one of the two ends of the connection tube 2-00 is inserted into the cylindrical surface 2-60. In addition, at least one of the two ends of the connection tube 2-00 forms a welding spot with the arc surface 2-01 that matches the water mixing seat 2 or the valve core seat 2-0.

Further, the welding spot of the valve core seat 2-0 and the water mixing seat 2 is a cylindrical surface 2-60, and the connection tube 2-00 is inserted into the holes of the openings of the valve core seat 2-0 and the water mixing seat 2. The welding position is the joint position of the valve core seat 2-0, the water mixing seat 2 and the connection tube 2-00. At the same time, the connection tube 2-00 is directly inserted into the interior of the valve core seat 2-0 and communicates with the valve core seat 2-0. The connection tube being directly inserted into the interior of the valve core seat 2-0 can contribute to the sealing performance of the connection joint and prevent liquid leakage.

Method 3

At least one of the water inlet of the water mixing seat 2 and the water outlet of the valve core seat 2-0 is a step hole 2-62, at least one of the two ends of the connection tube 2-00 is inserted into the step hole 2-62 and butt up against the step hole 2-62, and the connection position of at least one of the two ends of the connection tube 2-00 is a flat surface 2-02; and at least one of the two ends of the connection tube 2-00 forms a welding spot that matches the step hole 2-62 of the water mixing seat 2 or the valve core seat 2-0.

Furthermore, the water outlet hole of the valve core seat 2-0 and the water mixing seat 2 is a step hole 2-62 (refer to FIG. 12), and the connection tube 2-00 is inserted into the hole of the opening of the valve core seat 2-0 and the water mixing seat 2 to the step. The welding position is the joint position of the valve core seat 2-0, the water mixing seat 2 and the connection tube 2-00, thereby making the welding area more invisible, reducing the interference of the external environment on the welding process, and contributing to improve the welding quality. Meanwhile, this connection method can reduce the exposed area of the welding line, thereby reducing the chance to contact the corrosive medium, and enhancing the corrosion resistance of the overall structure. Moreover, due to the invisibility of the welding area, the preparation work before welding, such as cleaning and grinding, can be reduced, thereby saving time and labor.

Furthermore, the above three welding installation states combine the valve core seat 2-0, the water mixing seat 2 and the connection tube 2-00 to form the faucet body.

Specifically, the above three welding states are all applicable to the present application, and the present disclosure includes but is not limited to the above three welding states, and the specific implementation can be selected according to the actual situation.

In this embodiment, the outer sleeve 2-1, the first water sealing ring 2-2, and the threaded tube 2-3 are made of stainless steel, iron, or plastic, etc. Preferably, the outer sleeve 2-1, the first water sealing ring 2-2, and the threaded tube 2-3 are all made of stainless steel.

Further, the outer sleeve 2-1, the first water sealing ring 2-2, and the threaded tube 2-3 may be connected by laser welding, screws, or integral molding, etc. Preferably, the outer sleeve 2-1, the first water sealing ring 2-2, and the threaded tube 2-3 are connected by laser welding.

The valve core seat may be assembled by any two of the following welding methods.

Method 1: welding the outer sleeve 2-1 and the first water sealing ring 2-2 together by laser welding technology, wherein the laser welding can achieve high-precision welding, is free of the impact of magnetic fields, so as to accurately target the weldment. During the welding process, the welding quality can be ensured by controlling the parameters including width, energy, peak power and repetition frequency of the laser pulse, etc. Then, an end of the threaded tube 2-3 is laser welded to the bottom of the first water sealing ring 2-2. Since laser welding is suitable for a wide range of materials, various heterogeneous materials can also be joined together, which helps to ensure the welding quality between different materials. Finally, the threaded tube 2-3 is welded to the inner wall of the outer sleeve 2-1 through the third welding point. This step has also benefited from the high precision and automation of laser welding and can ensure the accuracy and consistency of welding.

Method 2: first, laser welding the first water sealing ring 2-2 and the threaded tube 2-3 together. In this step, the laser welding featured automatic and high-speed can improve the welding efficiency. Then, the accessory formed by welding the first water sealing ring 2-2 and the threaded tube 2-3 is laser welded to the external sleeve 2-1. In this step, the accuracy and quality of welding can be ensured by precisely controlling the focus and movement of the laser beam. Preferably, in method 2, during the welding of the accessory to the external sleeve 2-1, the welding head can go deep inside from the top of the external sleeve 2-1, thereby reducing the difficulty of operation. This is because the overall height of the external sleeve 2-1 is significantly smaller than that of the threaded tube 2-3, and thus offering sufficient space for operation.

Furthermore, in method 1, welding is carried out in steps, and the welding of each welding point is carried out independently, so that the welding quality of each welding point can be controlled more accurately, especially when the threaded tube 2-3 is welded to the inner wall of the external sleeve 2-1, the positioning accuracy of the threaded tube 2-3 can be ensured. Further, since the welding is carried out in steps, the welding parameters in each step can be optimized separately, such as laser power, speed, focal position, etc., so as to adapt to different materials and welding requirements. While in method 2, the first water sealing ring 2-2 and the threaded tube 2-3 are first welded together (including the second welding point 2-5), and then the combination is welded to the external sleeve 2-1 (the third weld point 2-6), so as to improve production efficiency.

Compared with the valve body produced by integral molding on the market, the combination and welding method of this embodiment is more cost-effective and is also convenient for the connection of the hose 30. The hose 30 can be quickly assembled and disassembled, thereby saving time and labor and improving work efficiency.

Embodiment 2

Figure 8:
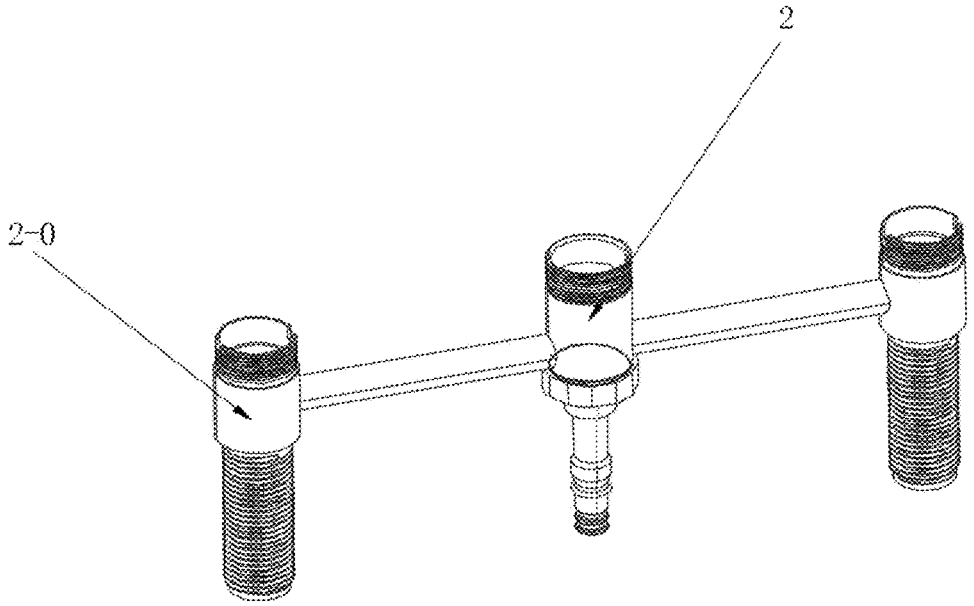
FIG. 8 is a structural diagram of Embodiment 2.
Figure 9:
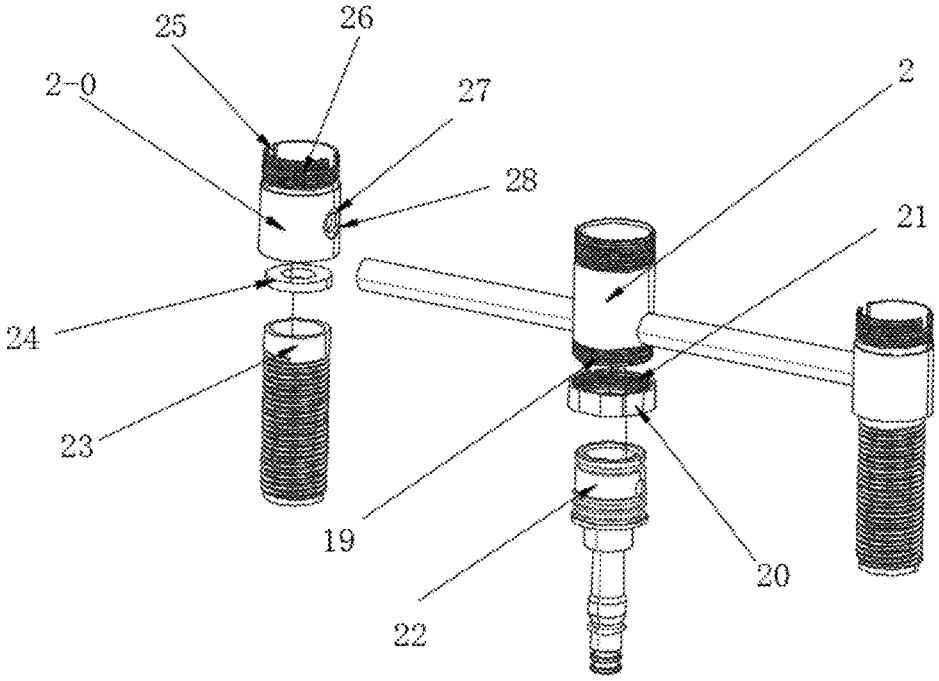
FIG. 9 is an exploded view of Embodiment 2.

A faucet body assembly which is different from Embodiment 1 in that, as shown in FIGS. 8-9, the water mixing seat 2 is different from Embodiment 1. The connection end of the water mixing seat 2 of this embodiment is formed with a first external thread 19, and the connection end of the water mixing seat 2 is also connected with a water outlet connector 22, an end of the water outlet connector 22 is sleeved with a lock nut 20, and an end of the lock nut 20 is formed with an internal thread 21 that matches the first external thread 19 for fixation. Specifically, the internal thread 21 in the lock nut 20 is screwed with the first external thread 19, so that the water outlet connector 22 allows liquid to flow out.

Either end of the connection tube is welded to the valve core seat 2-0 to form a fourth welding point 28, and an outer wall of the valve core seat 2-0 is formed with an interface 27 in communication with the connection tube.

At least three sets of sealing rings are arranged inside the water mixing seat 2 and at a position connected to either end of the water outlet connector 22, which is beneficial to the sealing of the water outlet connector 22 and can avoid water leakage between the water outlet connector 22 and the water mixing seat 2.

Additionally, the sealing ring matches the annular groove at an end of the water outlet connector 22, so as to seal the water outlet connector 22 and the water mixing seat 2. Moreover, the triple seal is more conducive to the use of the water outlet connector 22. Further, the sealing rings include but are not limited to three sets, and may be four sets or several sets, which can be set according to actual needs.

The valve core seat 2-0 also includes a steel tube 23, a third water sealing ring 24 is arranged between the valve core seat 2-0 and the steel tube 23, and a notch 25 is provided at the other end of the valve core seat 2-0. The third water sealing ring 24 is made of stainless steel.

Figure 2:
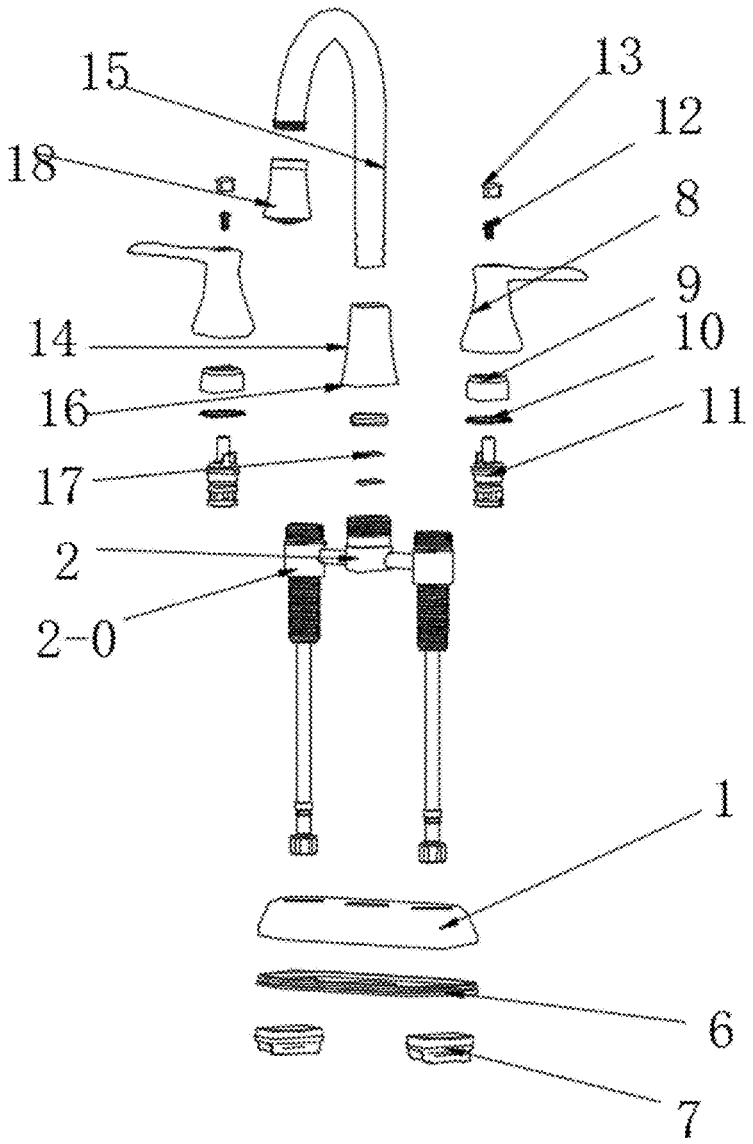
FIG. 2 is an exploded view of the present disclosure.
Figure 3:
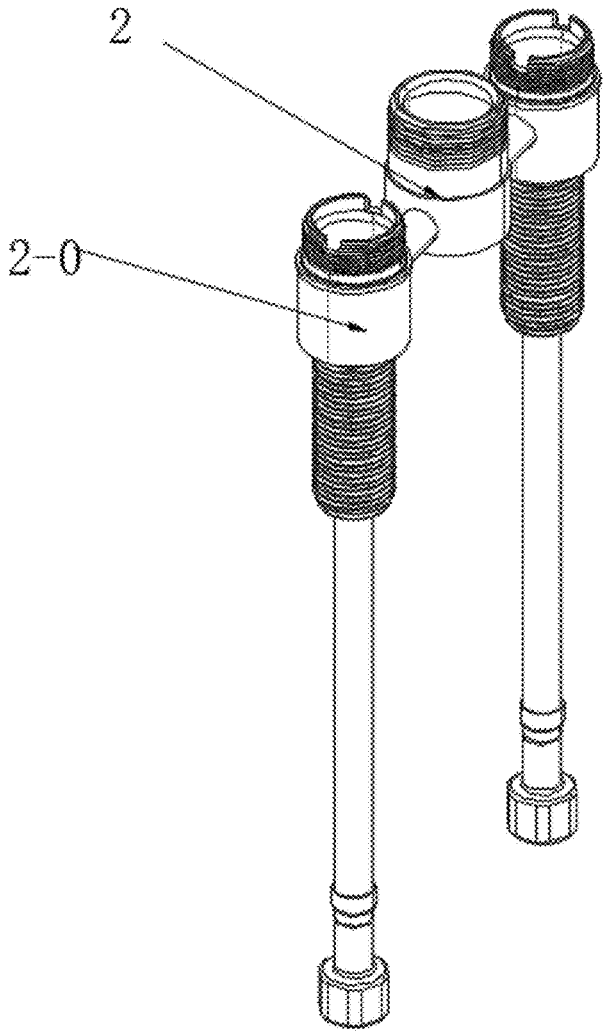
FIG. 3 is a structural diagram of Embodiment 1.
Figure 4:
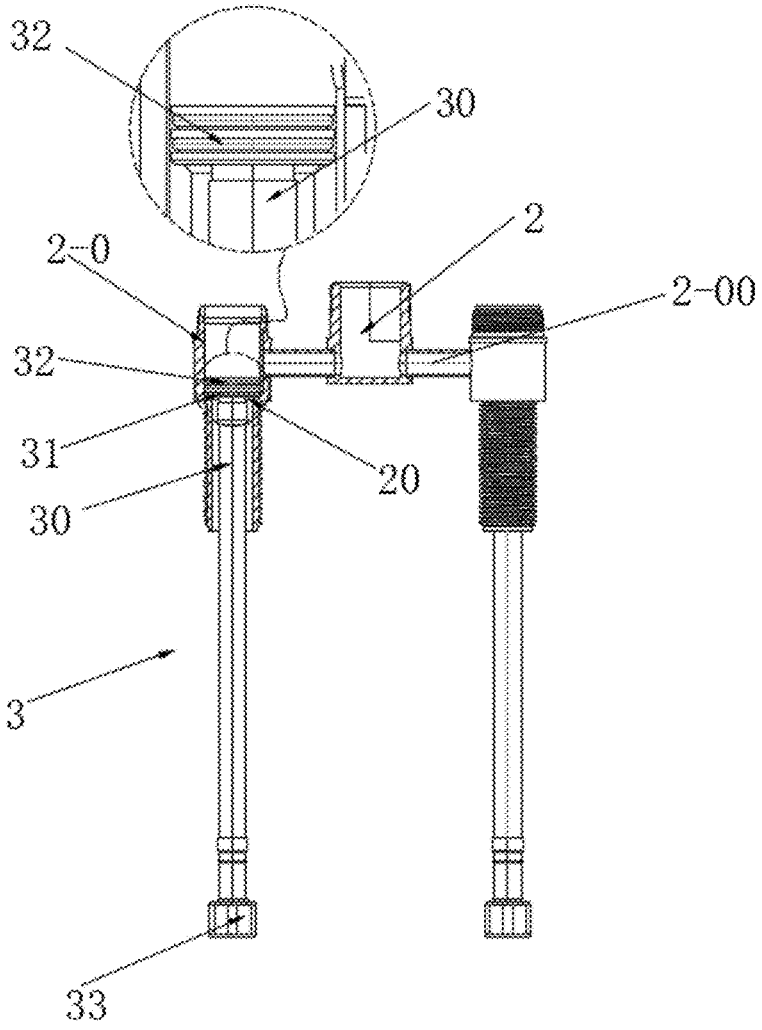
FIG. 4 is a cross-sectional view of Embodiment 1.
Figure 5:
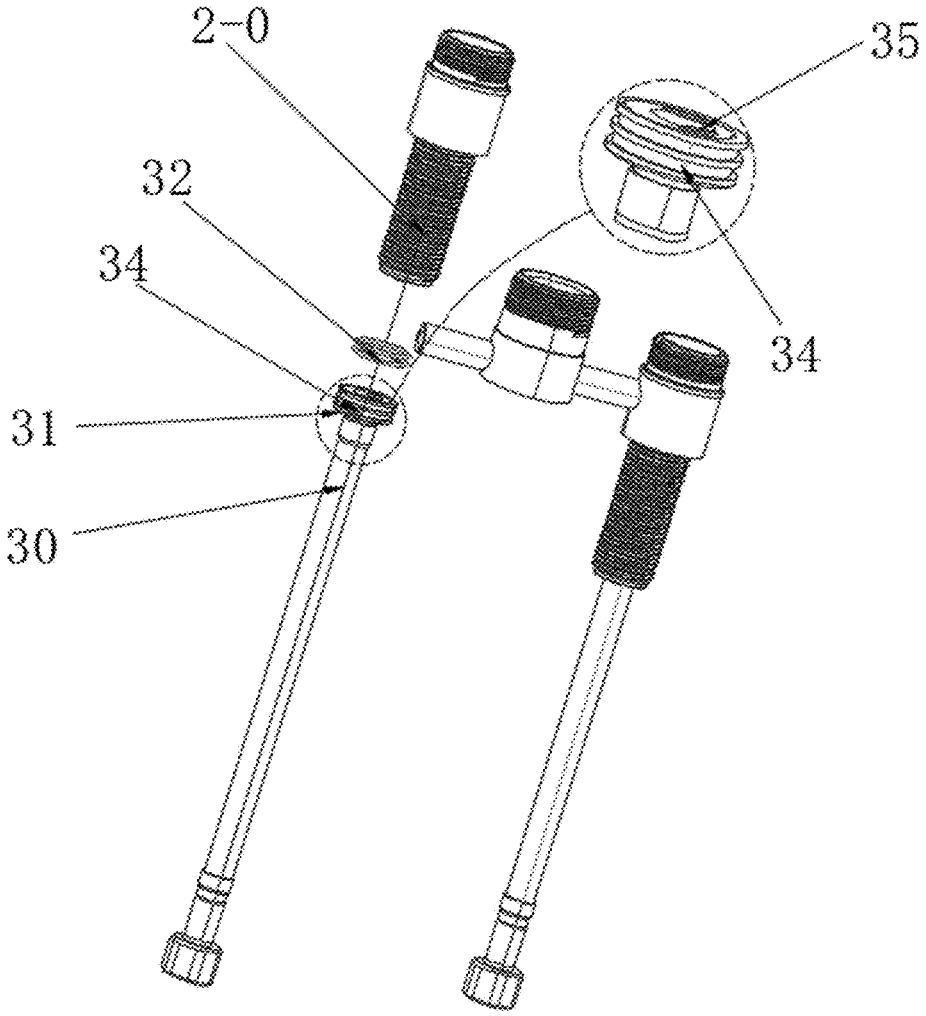
FIG. 5 is an exploded view of Embodiment 1.

Referring to FIGS. 1-2, a wash basin includes any one of the faucet body assemblies mentioned above, the basin faucet includes a decorative cover plate 1, a base plate 6 connected to the decorative cover plate 1 in a sealing manner, a first locking nut 7 arranged below the base plate 6 and configured to fix an end of the hose 30, and a water outlet faucet assembly arranged above the decorative cover plate 1.

In addition, the water faucet assembly includes a handle 8 arranged on the valve core seat 2-0, and a pressing cap 9, a gasket 10 and a valve core 11 are arranged between the handle 8 and the valve core seat 2-0 in sequence. The valve core 11 passes through the middle of the pressing cap 9 and the gasket 10 and is placed on the top of the handle 8, and the valve core 11 is fixed by a screw 12. The screw 12 is covered and hidden by a locking cover 13.

An end of the water mixing seat 2 is provided with an elbow tube 15, and an end of the elbow tube 15 is threadedly connected to a second locking nut 14. A clamping ring 16 and a second sealing ring 17 are provided between the elbow tube 15 and the second locking nut 14. The clamping ring 16 clamps and fixes the elbow tube 15, and the second sealing ring 17 seals the water mixing seat 2 and the elbow tube 15.

The water outlet end of the elbow tube 15 is provided with an aerator assembly 18. The aerator assembly 18 reduces the water consuming amount by mixing air with the water while maintaining the strength and coverage of the water flow, and can reduce the impact of the water flow, thereby making the water flow softer and suitable for user with sensitive skin or children. In addition, the aerator assembly 18 can reduce water splashing, so as to keep the area around the basin dry and clean, and the faucet can be integrated with a filter to filter impurities and particles in the water and to provide cleaner water flow.

Furthermore, in order to realize the function of automatically adjusting the ratio of water flow and bubbles, the aerator assembly 18 may be integrated with a sensor.

Furthermore, due to the diversity of water inlet methods of the valve core 11, some valve cores 11 have their inlet in the middle, and some have their inlet on one side, which requires the faucet body assembly to have higher applicability, so a water inlet adapter 29 is designed at the water inlet end of the valve core seat 2-0; when water flows in from the middle of the valve core 11, the faucet body assembly that is not eccentric on the right side (refer to FIG. 17-18) is selected, and when the water inlet of the valve core 11 is eccentric, the faucet body assembly with an eccentric adapter (refer to FIG. 15-16) is selected. The faucet body assembly is shared, and the water inlet adapters 29 are interchangeable for different valve cores 11, as follows.

Figure 15:
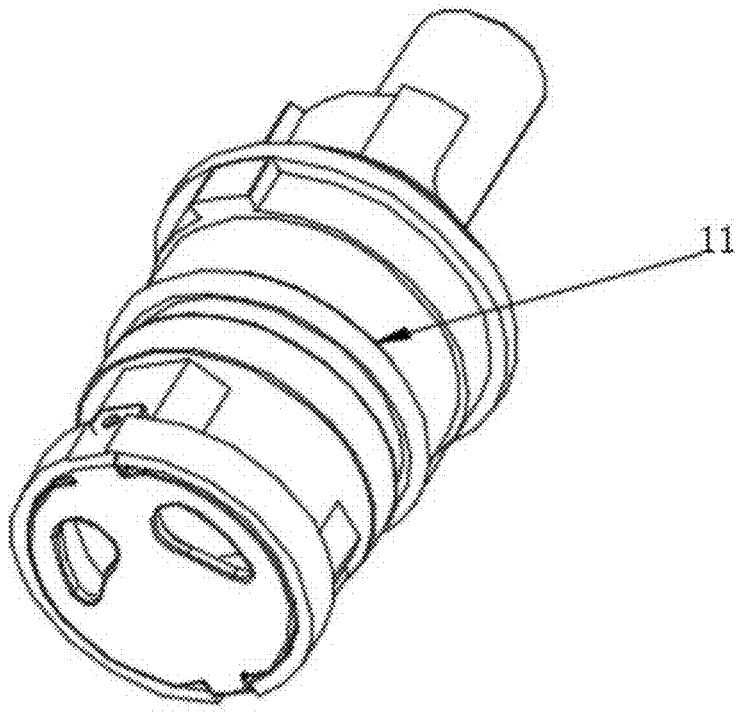
FIG. 15 is a schematic diagram of the valve core A of the present disclosure.
Figure 16:
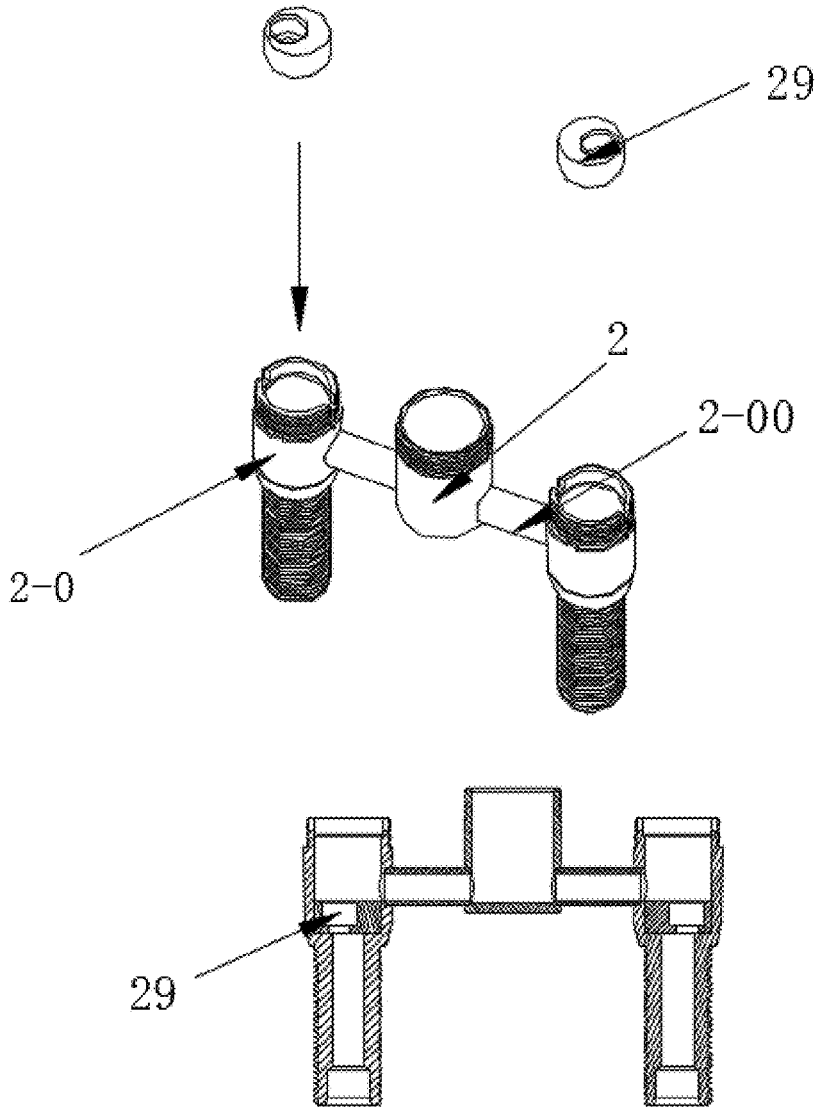
FIG. 16 is a schematic diagram of the installation of the water inlet adapter and the faucet body of the present disclosure.

Refer to FIG. 15-16

When the water inlet of the valve core seat 2-0 is eccentric, a valve core 11 with a water inlet on the side can be selected, and a water inlet adapter 29 is arranged in the valve core seat 2-0, thereby forming a faucet body assembly with a water inlet adapter 29, so that the faucet body assembly can adapt to different water inlet methods and installation environments. At the same time, the design with the water inlet adapter 29 enables the faucet body assembly to better adapt to different installation conditions and space restrictions, thereby improving the applicability and flexibility of the product, and further enhancing the convenience of installation, facilitating maintenance and replacement, increasing water flow and water-saving effects, as well as improving the appearance of the product.

Figure 17:
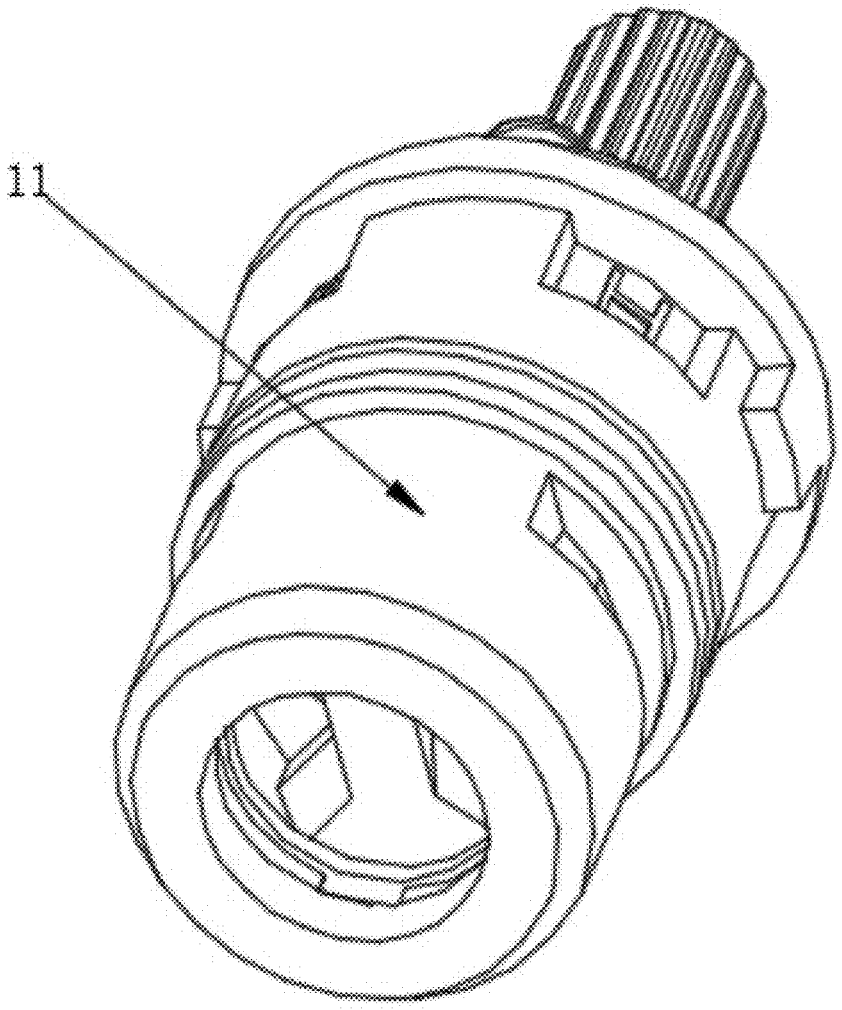
FIG. 17 is a schematic diagram of the valve core B of the present disclosure.
Figure 18:
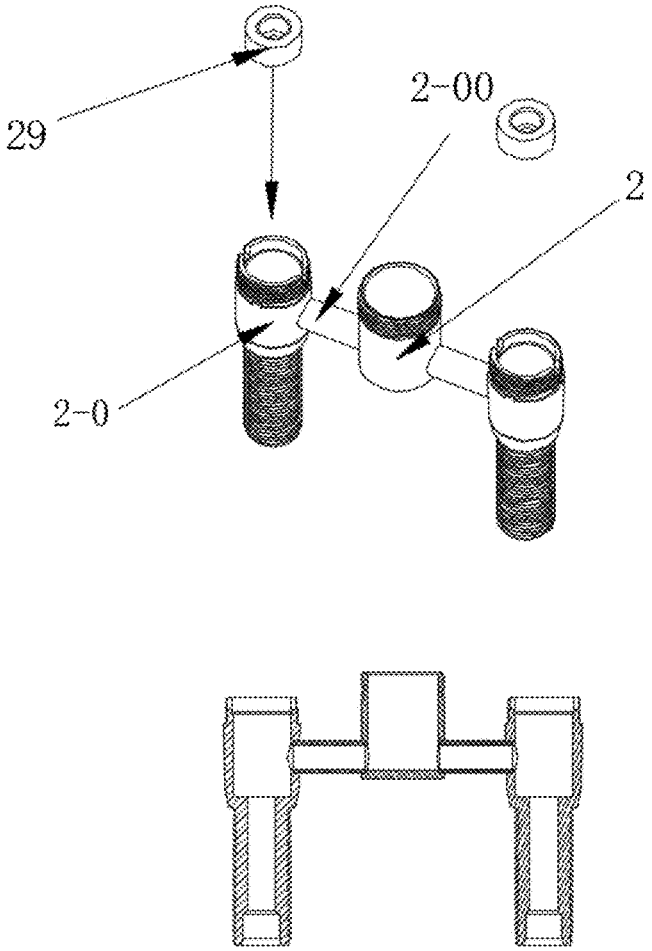
FIG. 18 is a schematic diagram of the faucet body of the present disclosure.

Refer to FIG. 17-18

When the water inlet of the valve core seat 2-0 is from the middle, the water inlet adapter 29 may not be installed, and a valve core 11 with the water inlet in the middle may be selected to form a faucet body assembly without the water inlet adapter 29. The advantage of this configuration is that it can simplify the structure, reduce costs, and reduce the number of components, thereby making the faucet body assembly more economical and practical.

In summary, these two different valve core designs not only improve the adaptability and installation convenience of the faucet body assembly, but also enhance the appearance, economical efficiency and functionality of the product.

Furthermore, the material of the valve core 11 may be ceramic, stainless steel or copper, the material includes but is not limited to the above materials and can be selected according to actual conditions.

The above description only involves preferred embodiment of the present disclosure and is not intended to limit the present disclosure. For those skilled in the art, the present disclosure may have various modifications and variations. Any modification, equivalent substitution, improvement, etc. made within the spirit and principle of the present disclosure shall be included in the protection scope of the present disclosure.

What is claimed is:

1. A faucet body assembly, comprising a water mixing seat;

a valve core seat, wherein the valve core seat is symmetrically arranged on two sides of the water mixing seat, and an end of the valve core seat is formed with a valve core mount, the valve core seat further comprises a steel tube and a water sealing ring arranged between the valve core seat and the steel tube;

a connection tube connecting the water mixing seat and the valve core seat;

wherein a water passage of the faucet body assembly comprises water flowing in from a water inlet of the valve core seat, after being regulated by the valve core seat, passing through the connection tube, and then entering the water mixing seat, cold and hot water from a left inlet and a right water inlet of the valve core seat being mixed in the water mixing seat and flowing out from the water mixing seat, and threads on a water outlet of the water mixing seat is connectable with a water outlet device;

the valve core seat and the water mixing seat or the valve core seat is welded by any of the following means:

configuring at least one of a water inlet of the water mixing seat and a water outlet of the valve core seat with a concave cylindrical surface, and configuring at least one of the two ends of the connection tube with an arc surface matched with the cylindrical surface to form a welding spot, or configuring at least one of the water inlet of the water mixing seat and the water outlet of the valve core seat with the concave cylindrical surface, and inserting at least one of the two ends of the connection tube into the cylindrical surface; and configuring at least one of the two ends of the connection tube with an arc surface matched with the water mixing seat or the valve core seat to form a welding spot, or configuring at least one of the water inlet of the water mixing seat and the water outlet of the valve core seat as a step hole, inserting at least one of the two ends of the connection tube into the step hole and to butt up against the step hole, and configuring at least one of the two ends of the connection tube with a flat surface; and at least one of the two ends of the connection tube forming a welding spot with the step hole of the mixing seat or the valve core seat.

2. The faucet body assembly according to claim 1 further comprising a water inlet hose assembly, wherein the water inlet hose assembly comprises a hose, a connection end arranged at the top of the hose and a water inlet connector arranged at the bottom of the hose; the connection end is engaged with the valve core mount; and the hose extends from the top of the valve core seat to the outside from top to bottom.

3. The faucet body assembly according to claim 2, wherein at least two sets of annular grooves are formed on the connection end, and first sealing rings are sleeved on the annular grooves.

4. The faucet body assembly according to claim 1, wherein the valve core seat comprises an external sleeve, a first water sealing ring arranged on a lower side of an inner wall of the external sleeve, and a threaded tube arranged below the first water sealing ring.

5. The faucet body assembly according to claim 4, wherein the first water sealing ring is welded to the lower side of the inner wall of the external sleeve by a first welding point; the threaded tube is welded to a lower portion of the first water sealing ring by a second welding point, and the threaded tube is welded to the inner wall of the external sleeve by a third welding point.

6. The faucet body assembly according to claim 1, wherein a connection end of the water mixing seat is formed with first external threads, and the connection end of the water mixing seat is also connected with a water outlet connector.

7. The faucet body assembly according to claim 6, wherein a lock nut is sleeved on an end of the water outlet connector, and an end of the lock nut is formed with internal threads for matching and fixing with the first external threads.

8. The faucet body assembly according to claim 1, wherein another end of the valve core seat is provided with a notch.

9. A basin faucet, comprising the faucet body assembly according to claim 1, wherein the basin faucet further comprises a decorative cover plate, a base plate sealed to the decorative cover plate, a first locking nut arranged below the base plate and configured to assemble and fix a connection end of the hose, and the faucet body assembly is arranged above the decorative cover plate.

* * * * *